US006051538A

United States Patent [19]

Majerczak

[11] Patent Number: 6,051,538

[45] Date of Patent: Apr. 18, 2000

[54] POUR POINT DEPRESSION OF HEAVY CUT METHYL ESTERS VIA ALKYL METHACRYLATE COPOLYMER

[75] Inventor: Victoria Ann Majerczak, Loveland, Ohio

[73] Assignee: The Procter & Gamble Company, Cincinnati, Ohio

[21] Appl. No.: 09/237,626

[22] Filed: Jan. 26, 1999

[51] Int. Cl.[7] ..... C10M 145/14

[52] U.S. Cl. ..... 508/469; 72/42; 508/463

[58] Field of Search ..... 508/463, 469; 72/42; 526/328.5

[56] References Cited

U.S. PATENT DOCUMENTS

| | | | |
|---|---|---|---|
| 3,598,736 | 8/1971 | Van der Meij et al. | 508/469 |
| 3,679,644 | 7/1972 | Van der Meij et al. | 508/469 |
| 4,031,019 | 6/1977 | Bell | 508/463 |
| 4,882,077 | 11/1989 | Cox | 508/463 |
| 5,338,471 | 8/1994 | Lal | 252/56 |
| 5,389,113 | 2/1995 | Demmering et al. | 44/388 |
| 5,508,035 | 4/1996 | Wessling et al. | 424/405 |
| 5,589,181 | 12/1996 | Bencsits | 424/405 |
| 5,612,048 | 3/1997 | Synek | 424/409 |
| 5,713,965 | 2/1998 | Foglia et al. | 44/388 |
| 5,716,917 | 2/1998 | Williams et al. | 508/547 |
| 5,834,408 | 11/1998 | Mishra et al. | 508/469 |

*Primary Examiner*—Jacqueline V. Howard
*Attorney, Agent, or Firm*—Jason J. Camp

[57] ABSTRACT

Compositions are provided which comprise heavy cut methyl esters and copolymer additives. The compositions of the present invention have pour points which are lower than compositions containing only heavy cut methyl esters without copolymer additives. In particular, alkyl methacrylate copolymer additives are used to achieve desirable pour points. The present invention also encompasses processes for making methyl ester compositions having depressed pour points and methods of using said compositions.

12 Claims, No Drawings

POUR POINT DEPRESSION OF HEAVY CUT METHYL ESTERS VIA ALKYL METHACRYLATE COPOLYMER

TECHNICAL FIELD

The present invention relates to heavy cut methyl ester compositions containing copolymer additives which result in lower pour points as compared to methyl ester compositions without such copolymer additives. Specifically, heavy cut methyl ester compositions containing alkyl methacrylate copolymers are provided that result in lower pour points to solve problems that plague current compositions in the metalworking lubricant, agricultural adjuvant, drilling mud, and biodiesel fuel markets.

BACKGROUND OF THE INVENTION

Heavy cut methyl esters of vegetable oils and animal fats, as defined hereinafter, are useful in a variety of contexts. In particular, heavy cut methyl esters have been used as lubricants in the metalworking industry. See, e.g., Williams et al., U.S. Pat. No. 5,716,917, issued Feb. 10, 1998. Heavy cut methyl esters are preferred over other types of lubricants, such as mineral oils, due to their lower cost, lower toxicity, and environmental friendliness. However, a disadvantage for using heavy cut methyl esters as metalworking lubricants relates to their relatively high pour points, which are typically at or above the freezing point of water. This disadvantage has prevented these low cost, low toxicity, and environmentally friendly, heavy cut methyl esters from becoming more widely used as metalworking lubricants. It has been desired to discover a way to lower the pour points of these heavy cut methyl esters so that they can be more effectively used as metalworking lubricants.

Heavy cut methyl esters of vegetable oils and animal fats are also particularly useful in the agricultural adjuvant market, in which they are used as carriers for the active ingredients in pesticides. See, e.g., Synek, U.S. Pat. No. 5,612,048, issued Mar. 18, 1997; Wessling et al., U.S. Pat. No. 5,508,035, issued Apr. 16, 1996; Bencsits, U.S. Pat. No. 5,589,181, issued Dec. 31, 1996. Such pesticides are often stored outside in large drums for future agricultural use. However, in colder climates, such storage can result in the pesticides becoming frozen, which then requires a great amount of effort to thaw the pesticides before use. While other carriers, such as mineral oils, can be used so that the pesticides do not freeze quite as readily, their cost is prohibitive and their use has raised environmental concerns. Using heavy cut methyl esters as the carrier material in pesticides has economic and environmental benefits. Thus, it has been desired to create heavy cut methyl ester compositions with lower pour points to be used as a carrier in pesticides which will not freeze as readily when stored outside in colder climates.

Heavy cut methyl esters of vegetable oils and animal fats have also been useful as a base for drilling muds and fluids. See, e.g., *Advances in Drilling Covered at Conference in Southeast Asia,* OIL & GAS JOURNAL, p. 41 (PennWell Publ'g Feb. 1, 1993). Diesel and mineral oils have typically been used as the base for these muds and fluids, however their use has raised environmental concerns. Due to their environmental friendliness, heavy cut methyl esters have been effectively used as a base for drilling muds and fluids. However, heavy cut methyl esters are undesirable for use in drilling muds in colder climates due to their higher pour points.

Heavy cut methyl esters have also been useful as biodiesel fuels. See, e.g., Foglia et al., U.S. Pat. No. 5,713,965, issued Feb. 3, 1998; Demmering et al., U.S. Pat. No. 5,389,113, issued Feb. 14, 1995; Lal, U.S. Pat. No. 5,338,471, issued Aug. 16, 1994. As previously discussed, a disadvantage to using heavy cut methyl esters has been their relatively high pour points, which causes them to solidify in fuel pipes at temperatures at or above the freezing point of water so that they cannot be effectively used as biodiesel fuel under winter conditions in cold climates.

SUMMARY OF THE INVENTION

The present invention relates to the pour point depression of heavy cut methyl esters by the addition of an alkyl methacrylate copolymer. The pour points of such methyl ester compositions can be further depressed by a minimal amount of agitation after the addition of the alkyl methacrylate copolymer. The ability to achieve a lower pour point for heavy cut methyl ester compositions is especially important for the use of methyl esters as metalworking lubricants, as carriers for active ingredients in pesticides which do not freeze as readily upon outdoor storage in cold climates, as a base for drilling muds and fluids, and as biodiesel fuels which do not freeze in fuel pipes at winter temperatures in cold climates.

The present invention encompasses heavy cut methyl ester compositions containing copolymer additives which have lower pour points as compared to methyl ester compositions without such copolymer additives. The compositions of the present invention comprise:

(I) from about 95% to about 99%, by weight of the composition, of a methyl ester, or mixtures thereof, of fatty acids having from about 14 to about 24 carbon atoms; wherein said methyl ester has an iodine value from about 75 to about 125; and (II) from about 1% to about 5%, by weight of the composition, of a copolymer additive comprising:

(A) from about 25% to about 75%, by weight of the copolymer additive, of a polymer comprising:

(i) from about 70% to about 99.5%, by weight of the polymer, first repeating units, each derived from a $C_8$–$C_{15}$ alkyl methacrylate monomer; and (ii) from about 0.5% to about 30%, by weight of the polymer, second repeating units, each derived from a $C_{16}$–$C_{24}$ alkyl methacrylate monomer; and (B) from about 25% to about 75%, by weight of the copolymer additive, of a vegetable oil or polyol ester.

The compositions of the present invention have pour points below about 5° C., preferably below about 0° C., more preferably below about −5° C. Once the compositions of the present invention begin to crystallize, their pour points can be further depressed, by agitation, to temperatures below about 0° C., preferably below about −5° C., more preferably below about −12° C.

The present invention also encompasses processes for making heavy cut methyl ester compositions having depressed pour points and methods of using said compositions.

Unless otherwise noted, all documents cited herein are incorporated by reference.

DETAILED DESCRIPTION OF THE INVENTION

The heavy cut methyl ester compositions of the present invention contain heavy cut methyl esters mixed with alkyl methacrylate copolymer additives, which result in the compositions having pour points which are lower than heavy cut methyl esters without such copolymer additives. The heavy cut methyl ester compositions of the present invention comprise from about 95% to about 99%, preferably from about 96% to about 98.5%, more preferably from about 97% to about 98%, heavy cut methyl esters; and from about 1% to about 5%, preferably from about 1.5% to about 4%, more preferably from about 2% to about 3%, alkyl methacrylate copolymer additive.

Using ASTM Method D97 to measure pour point, the compositions of the present invention exhibit pour points less than about 5° C., preferably less than about 0° C., more preferably less than about −5° C. It has been discovered that, by agitation, the compositions of the present invention can exhibit pour points of less than about 0° C., preferably less than about −5° C., more preferably less than about −12° C. Once the compositions begin to crystallize or solidify, agitation serves to break the initial crystalline structure formation and allows the compositions to attain lower pour points. Such agitation can be accomplished by stirring or shaking the compositions, i.e., with a stirring rod or shaking the mixing vessel. To minimize the amount of agitation required to break the initial crystalline structure formation, the present compositions preferably contain greater than about 2% copolymer additive.

As described hereinafter in Example IV, an oscillatory stress test can be used to determine the amount of force necessary to break the crystalline structure at −15° C. The "rigidity," expressed as the complex modulus (G*), of the compositions of the present invention, which contain copolymer additive, is much less than heavy cut methyl esters without such copolymer additive. The addition of about 1.5% or about 2.5% copolymer additive serves to reduce the magnitude of the complex modulus by about 1 order of magnitude or about 2 orders of magnitude, respectively, as compared to heavy cut methyl esters containing no copolymer additive.

Heavy Cut Methyl Esters

As used herein, the term "heavy cut" refers to compositions which contain fatty acyl groups having chainlengths of about 14 or more carbon atoms. In the heavy cut methyl esters of the present invention, the chainlengths of the fatty acyl groups in the methyl esters are from about 14 to about 24 carbon atoms, preferably from about 16 to about 20 carbon atoms, and more preferably substantially all containing 16 or 18 carbon atoms. The heavy cut methyl esters are substantially free of fatty acyl groups having chainlengths of less than about 14 carbon atoms.

The heavy cut methyl esters of the present invention are technical mixtures of methyl esters of $C_{14}$–$C_{24}$ fatty acids, i.e., myristic acid, stearic acid, linoleic acid, palmitic acid, oleic acid, and similar fatty acids, which have iodine values ("IV") of about 75 to about 125. Preferably, the methyl esters have IVs of about 80 to about 110, more preferably about 85 to about 100. Methyl esters having IVs in the lower end of the above ranges are preferred in order to optimize the stability of the compositions, by limiting methyl esters with 2 or more unsaturates, and to improve the effectiveness of the copolymer additive in depressing the pour points of the compositions, by limiting the amount of saturated esters.

Preferred heavy cut methyl esters useful in the present invention comprise from about 0.5% to about 26% $C_{16}$ methyl esters, from about 8% to about 11% $C_{18}$ methyl esters (saturated), from about 55% to about 80% $C_{18:1}$ methyl esters (having 1 degree of unsaturation), and from about 9% to about 12% $C_{18:2}$ methyl esters (having 2 degrees of unsaturation).

The heavy cut methyl esters are preferably derived from myristic acid, stearic acid, linoleic acid, palmitic acid, and oleic acid. Highly preferred heavy cut methyl esters useful in the compositions of the present invention comprise:

| Ingredient | Amount (by weight) |
|---|---|
| Methyl Myristate ($C_{14}$) | less than about 1.0% |
| Methyl Stearate ($C_{18}$) | about 11% |
| Methyl Linoleate ($C_{18:2}$) | about 13% |
| Methyl Palmitate ($C_{16}$) | about 0.6% |
| Methyl Oleate ($C_{18:1}$) | greater than about 70% |

The technical mixtures of the heavy cut methyl esters described hereinbefore are obtained, for example, by hydrogenation and esterfication of natural fats and oils or by transesterfication thereof with methanol. Preferably, the heavy cut methyl esters of the present invention are produced from palm kernal oil, coconut oil, or beef tallow. More preferably, the heavy cut methyl esters are produced from palm kernal oil. Heavy cut methyl esters useful in the compositions of the present invention are commercially available, for example, from the Procter & Gamble Company under the tradenames CE-1897™ and CE-1618™.

Alkyl Methacrylate Copolymer Additive

The copolymer of the present invention includes from about 70% to about 99.5%, preferably from about 82% to about 97.5%, first repeating units, each derived from a $C_8$–$C_{15}$ alkyl methacrylate monomer, and from about 0.5% to about 30%, preferably from about 2.5% to about 18%, second repeating units, each derived from a $C_{16}$–$C_{24}$ alkyl methacrylate monomer. In a highly preferred embodiment, the polymer includes from 92.5% to 95% first repeating units, each derived from a $C_8$–$C_{15}$ alkyl methacrylate monomer, and from 5% to 7.5% second repeating units, each derived from a $C_{16}$–$C_{24}$ alkyl methacrylate monomer.

As used herein, "methacrylate" refers collectively to acrylate and methacrylate compounds. Commercially available alkyl methacrylate monomers typically comprise a mixture of alkyl methacrylate esters. Such mixtures are referred to herein using the name of the ester species predominating in the mixture.

The $C_8$–$C_{15}$ alkyl methacrylate monomers used herein contain any straight or branched alkyl group having 8 to 15 carbon atoms per group, e.g., octyl, nonyl, n-decyl, isodecyl, undecyl lauryl, tridecyl, myristyl, or pentadecyl. Suitable $C_8$–$C_{15}$ alkyl methacrylate monomers include octyl methacrylate, octyl acrylate, nonyl methacrylate, decyl methacrylate, decyl acrylate, isodecyl methacrylate, undecyl methacrylate, laudyl methacrylate, lauryl acrylate, tridecyl methacrylate, myristyl methacrylate, pentadecyl methacrylate, pentadecyl acrylate, and mixtures thereof. In a preferred embodiment, the $C_8$–$C_{15}$ alkyl methacrylate monomer is lauryl methacrylate, myristyl methacrylate, or a mixture thereof.

The $C_{16}$–$C_{24}$ alkyl methacrylate monomers used herein contain any straight or branched alkyl group having 16 to 24 carbon atoms per group, e.g., stearyl, catyl, heptadecyl, nonadecyl, or eicosyl. Suitable $C_{16}$–$C_{24}$ alkyl methacrylate monomers include stearyl methacrylate, catyl methacrylate, cetyl acrylate, eicosyl methacrylate and mixtures thereof. In a preferred embodiment, the $C_{16}$–$C_{24}$ alkyl methacrylate monomer is cetyl methacrylate, stearyl methacrylate, eicosyl methacrylate, or a mixture thereof.

In a preferred embodiment, the copolymer additive exhibits a weight average molecular weight, determined, e.g., by gel permeation chromatography, from about 50,000 to about 1,000,000, more preferably, from about 150,000 to about 250,000.

A copolymer additive useful is the compositions of the present invention is commercially available, for example, from Rohm & Haas Ltd. under the tradename ACRYLOID™ EF-171.

The copolymer additive of the present invention is made, for example, by a free radical initiated solution polymerization of methacrylate monomers in an oil soluble diluent, in the presence of a polymerization initiator.

Suitable polymerization initiators include initiators which disassociate upon heating to yield a free radical, e.g., peroxide compounds such as benzoic peroxide, t-butyl peroctoate, cumene hydroperoxide, and azo compounds such as azoisobutylnitrile, 2,2'-azobis(2-methylbutanenitrile). T-butyl peroctoate is preferred as the polymerization initiator. The mixture includes, e.g., from about 0.25% to about 1.0% initiator per 100% total monomer charge and, more preferably, from about 0.6% to about 0.8% initiator per 100% total monomer charge.

The diluent may be any inert liquid that is miscible with the heavy cut methyl esters in which the copolymer is to be subsequently used. Preferably, the diluent is a mineral oil or other similar neutral oil that is miscible with the heavy cut methyl esters in which the copolymer is to be subsequently used. The mixture includes, e.g., from 20% to 400% diluent per 100% total monomer charge and, more preferably, from about 50% to about 200% diluent per 100% total monomer charge. As used herein, "total monomer charge" means the combined amount of all monomers added to the reaction mixture over the entire course of the polymerization reaction.

The reaction mixture may optionally include a chain transfer agent. Suitable chain transfer agents include those conventional in the art, e.g., dodecyl mercaptan or ethyl mercaptan. Dodecyl mercaptan is preferred as the chain transfer agent. The selection of the mount of chain transfer agent to be used is based on the desired molecular weight of the polymer being synthesized. The reaction mixture typically includes, e.g., from about 0.5% to about 1.0% chain transfer agent per 100% total monomer charge and, more preferably, includes from about 0.6% to about 0.8% chain transfer agent per 100% total monomer charge.

In one method for preparing the copolymer additive, the reactants are charged to a reaction vessel that is equipped with a stirrer, a thermometer and a reflux condenser and heated with stirring under a nitrogen blanket to a temperature from about 90° C. to about 125° C. The reaction mixture is then maintained at a temperature from about 90° C. to about 125° C. for a period of about 0.5 hours to about 12 hours to form the copolymer. In a preferred embodiment of the process for making the copolymer additive, the polymerization initiator may be fed to the reaction vessel, either continuously or as one or more discrete portions, as the polymerization progresses, provided that the batch is then maintained at a temperature within the above-specified range with stirring for an additional period of about 0.5 hours to about 6 hours subsequent to the last addition of initiator.

The copolymer additive is mixed with the heavy cut methyl esters by the processes described hereinafter to form the present compositions having desirable pour points.

Process for Making Compositions of the Present Invention

The heavy cut methyl ester compositions having depressed pour points of the present invention are obtained by blending the heavy cut methyl esters with the copolymer additive. The process of the present invention results in the commercial production of heavy cut methyl ester compositions having depressed pour points. Initially, the copolymer additive is preferably heated to about 70° C. (about 160° F.) to make the copolymer less viscous for purposes of mixing. The heavy cut methyl ester is preferably heated to about 25° C. (about 76° F.), also to ease the mixing process. A cone bottom tank is preferably used as the mixing vessel for the blending operation. A line is connected to the cone bottom tank and the heavy cut methyl ester and copolymer additive are initially blended using an injection pump connected to the line. The methyl ester and copolymer additive are then pumped into the bottom of the cone bottom tank. Nitrogen is preferably blown into the cone bottom tank to ensure mixing of the methyl ester and copolymer additive. Preferably, the methyl ester is pumped into the cone bottom tank at a rate of about 235 to about 265 liters (about 60 to about 70 gallons) per minute and the copolymer additive at a rate of about 5.7 liters (1.5 gallons) per minute. However, the flow rate of the copolymer additive can become slower as the temperature of the copolymer additive drops. Therefore, it is preferred that the copolymer additive be stored in a heated tank to keep the copolymer additive heated to ease pumping. Also, using a larger line and/or a larger pump can aid in the pumping of the copolymer additive. Using an in-line mixer after the injection point of the copolymer additive into the methyl ester can also aid in the mixing process and can eliminate the need for nitrogen sparging during mixing. After effective amounts of the methyl ester and copolymer additive have been added to the cone bottom tank, the tank is placed in recirculation for about 1 hour to complete the mixing process. The resulting heavy cut methyl ester composition can then be pumped into a railcar, drum, or similar storage device for long-term storage or transportation. Occasional blending may be necessary to prevent settling of crystals in colder climates.

Methods of Use

The methyl ester compositions of the present invention are useful in a variety of contexts. In the metalworking industry, the compositions of the present invention are useful as lubricants which can be applied at the interface between a machine tool and a workpiece in order to cool the machine tool and workpiece, to remove debris from the machine tool/workpiece interface, and to reduce friction between the machine tool and workpiece. The compositions of the present invention can also be useful as lubricant ingredients in aqueous metalworking fluids.

The methyl ester compositions of the present invention are also useful as carriers for active ingredients in pesticides. Such use can be as a carrier either in dry pesticide formulations, in which the methyl ester compositions protect the active ingredients from degradation due to moisture contact, or in liquid pesticide formulations, in which the compositions provide a liquid carrying medium.

The present compositions can be used as base ingredients in drilling muds and fluids for drilling rigs. In particular, the present compositions are useful in nontoxic invert emulsion drilling mud. They are especially useful as base ingredients in mud for drilling through productive zones and water-sensitive formations. The drilling muds and fluids can be used to carry chips and cuttings produced by drilling to the surface, to lubricate and cool the drill bit, to form a filter cake which obstructs filtrate invasion in the formation, to maintain the walls of the borehole, to control formation pressures and prevent lost returns, to suspend cuttings during rig shutdowns, and to protect the formation for later completion and shutdown.

Also, the methyl ester compositions of the present invention can be used as biodiesel fuel. Biodiesel fuels, which are obtained from vegetable oils and animals fats, are being used as alternatives to diesel fuels, which are obtained from petroleum and natural gas, for automobile engines and other types of engines, due to environmental concerns.

All parts, percentages, and ratios herein are "by weight" unless otherwise stated. All numerical values are approximations based upon normal confidence limits unless otherwise stated.

The following Examples illustrate the processes and compositions of the present invention, but are not intended to be limiting thereof.

EXAMPLE I

About 1400 kilograms (about 3090 pounds) of copolymer additive are heated to about 70° C. (about 160° F.) to make the copolymer less viscous. About 59,400 kilograms (about 130,945 pounds) of heavy cut methyl ester are slightly heated to about 25° C. (about 76° F.). The methyl ester and copolymer additive are then initially blended using an injection pump connected to a line to a cone bottom tank, which is used for the blending operation. The methyl ester and copolymer additive are pumped into the bottom of the cone bottom tank. Nitrogen is blown into the cone bottom tank to ensure mixing of the methyl ester and copolymer additive. The methyl ester is added to the cone bottom tank at a rate of about 230 to about 265 liters (about 60 to about 70 gallons) per minute. The copolymer additive is added to the cone bottom tank at a rate of about 5.7 liters (about 1.5 gallons) per minute, but the flow rate can become slower as the temperature of the copolymer additive drops. After all of the copolymer is added, the cone bottom tank is placed in recirculation for about 1 hour to complete the blending. The pour point of the resulting composition, which contains about 2.3% copolymer additive, by weight of the composition, is about −25° C.

EXAMPLE II

About 13.3 kilograms (about 29.4 pounds) of heavy cut methyl ester and about 0.27 kilograms (about 0.60 pounds) of copolymer additive are added to a mixing drum. The contents of the mixing drum are agitated using a mechanical mixer for about 1 hour. The pour point of the resulting composition, which contains about 2.04% copolymer additive, by weight of the composition, is about −17° C.

EXAMPLE III

The pour points of the following compositions are measured:

| | Composition A (CE-1618) | Composition B (CE-1897) | Composition C (50:50 Mix of CE-1618 and CE-1897) |
|---|---|---|---|
| $C_{16}$ Methyl Esters | 26% | 0.5% | 13% |
| $C_{18:0}$ Methyl Esters | 8% | 11% | 9% |
| $C_{18:1}$ Methyl Esters | 56% | 75% | 66% |
| $C_{18:2}$ Methyl Esters | 9% | 12% | 11% |
| $C_{14}$ Methl Esters | Balance | Balance | Balance |

Measuring the pour points of the above compositions is performed using ASTM Method D97, which does not include agitation. The pour points are measured without agitating the compositions. However, ASTM Method D97 is then slightly modified by agitating the compositions, once they begin to crystallize, by stirring or shaking. The pour points of the compositions are also measured after they have been agitated. The following shows the resulting pour points:

| % | Composition A Pour Points (°C.) | | Composition B Pour Points (°C.) | | Composition C Pour Points (°C.) | |
|---|---|---|---|---|---|---|
| Additive (EF-141) | Without Agitation | With Agitation | Without Agitation | With Agitation | Without Agitation | With Agitation |
| 0% | 8–9° C. | — | 5–6° C. | — | 6° C. | — |
| 1.0% | — | — | — | — | — | −20° C. |
| 2.0% | 4° C. | −1° C. | −7° C. | −17° C. | — | −17° C. |
| 2.5% | — | — | −5° C. | −15° C. | — | −17° C. |
| 3.0% | 1° C. | — | −7° C. | −17° C. | −6° C. | −17° C. |
| 3.5% | — | — | −5° C. | −15° C. | — | −15° C. |
| 4.0% | 0° C. | — | −7.5° C. | −12° C. | −8° C. | −12° C. |
| 4.5% | — | — | −6° C. | −30° C. | — | −30° C. |
| 5.0% | 0° C. | −5° C. | −5° C. | <−30° C. | — | <−30° C. |
| 5.5% | — | — | — | −30° C. | — | <−30° C. |

The above compositions were agitated by manual stirring or shaking. The amount of force used to agitate the above compositions can be varied, for example by mechanical agitation, which will then vary the resulting pour points due to the amount of crystals actually broken by agitation.

The above results show that the addition of about 2% to about 3% copolymer additive to Composition B is preferred to achieve a desirable pour point.

EXAMPLE IV

The Rheometrics DSR Dynamic Stress Rheometer is used to perform oscillatory tests at −15° C. using a 4 cm 2 degree PEEK cone. The test is an oscillatory stress sweep from 100 to 10,000 dy/cm^2 at 1 Hz. The oscillatory tests provide information on the relative degree of viscoelastic structure between the samples.

The oscillatory test on a controlled stress rheometer is performed by applying a stress in an oscillatory manner and measuring the resulting oscillatory strain response and the phase shift (δ) between the applied stress waveform and the resulting strain waveform in the test material. The resulting complex modulus G*, which may be thought of as the "rigidity" or "stiffness" of the test material, is expressed as a combination of the material's elastic and viscous components as follows:

$$G^* = \sqrt{G'^2 + G''^2}$$

This modulus can be resolved into the following expressions:

$$G' = G^* \cos \delta$$

and $$G'' = G^* \sin \delta$$

The elastic modulus G' is a measure of a materials ability to store recoverable energy. This energy storage can be the result of the ability of a complex polymer, structural network, or a combination of these to recover stored energy after a deformation. The loss modulus G" is a measure of the unrecoverable energy which has been lost due to viscous dampening.

The environment around the test sample is purged with nitrogen in order to prevent the deposition of ice crystals onto the surface of the peltier plate and the measuring system geometry. The nitrogen is in the form of liquid nitrogen contained in an insulated vessel. This serves not only as a source for the nitrogen blanket but also acts to partition the available moisture in the enclosure by freezing it out onto the surface of the vessel which contains the liquid nitrogen.

Test samples are prepared by first heating to 40° C. for several minutes in order to assure complete melting of all constituents and then cooling to −15° C. and maintaining this temperature for 15 minutes prior to the beginning of the rheology test. The following represents the composition of the test samples:

| | Composition D (CE-1897) | Composition E (CE-1897 w/1.5% EF-171) | Composition F (CE-1897 w/2.5% EF-171) |
|---|---|---|---|
| $C_{16}$ Methyl Esters | 0.5% | 0.49% | 0.49% |
| $C_{18:0}$ Methyl Esters | 11% | 10.8% | 10.7% |
| $C_{18:1}$ Methyl Esters | 75% | 73.9% | 73.1% |
| $C_{18:2}$ Methyl Esters | 12% | 11.8% | 11.7% |
| Copolymer Additive (EF9-171) | — | 1.5% | 2.5% |
| $C_{14}$ Methyl Esters | Balance | Balance | Balance |

The results of the rheology tests are expressed in the following 2 graphs: a plot of the methyl ester complex modulus as a function of oscillatory stress and a plot of % strain as a function of oscillatory stress. The rigidity of each composition at −15° C. is shown in the following plots of complex modulus versus oscillatory stress:

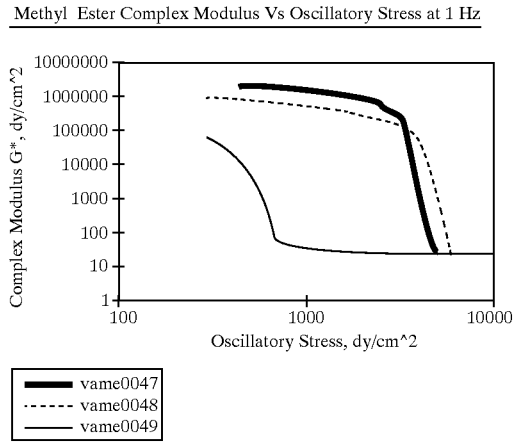

The above plot shows that Composition D, which contains no copolymer additive, is the most rigid of the methyl ester test samples at a temperature of −15° C., while Composition F, with 2.5% copolymer additive, is the least rigid at that temperature. The creation of Composition E, with 1.5% copolymer additive, acts to reduce the magnitude of the complex modulus, or rigidity, by about 1 order of magnitude. This means that Composition E is less rigid than Composition D, which contains no copolymer additive. However, there is relatively little change in the yield value, as judged by the transition from the horizontal plateau value of the modulus, compared to that achieved with the addition of the pour point copolymer additive.

The creation of Composition F, with 2.5% copolymer additive, decreases the complex modulus, or rigidity, by about 2 orders of magnitude, substantially reduces the yield value, and eases the transition into the flow regime, as compared to Composition D. This ease of transition can be observed in the following plots of % strain versus oscillatory stress:

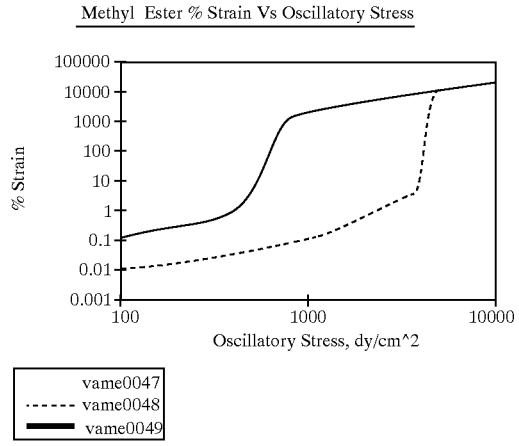

The above plot shows that there is a sharp transition into the flow regime for Composition D at 2750 dy/cm^2 (about 7% strain) and Composition E at 3700 dy/cm^2 (about 10% strain). Composition F shows a much more gradual transition into flow. The transition into the flow regime for Composition F begins at approximately 300 dynes/cm^2 (about 1% strain).

The addition of copolymer additive to heavy cut methyl esters, as in the present invention, serves to reduce overall rigidity, reduce the yield value, and ease the transition from the fully immobile frozen state to the fluid state.

What is claimed is:

1. A composition comprising:

(I) from about 95% to about 99%, by weight of the composition, of a methyl ester, or mixtures thereof, of fatty acids having from about 14 to about 24 carbon atoms; wherein said methyl ester has an iodine value from about 75 to about 125; and (II) from about 1% to about 5%, by weight of the composition, of a copolymer additive comprising:

(A) from about 25% to about 75%, by weight of the copolymer additive, of a polymer comprising:

(i) from about 70% to about 99.5%, by weight of the polymer, first repeating units, each derived from a $C_8$–$C_{15}$ alkyl methacrylate monomer; and (ii) from about 0.5% to about 30%, by weight of the polymer, second repeating units, each derived from a $C_{16}$–$C_{24}$ alkyl methacrylate monomer; and (B) from about 25% to about 75%, by weight of the copolymer additive, of a diluent selected from the group consisting of mineral oil vegetable oil, polyol ester and mixtures thereof.

2. A composition according to claim 1, wherein said composition comprises from about 96% to about 98.5%, by weight of the composition, of said methyl ester and from about 1.5% to about 4%, by weight of the composition, of said copolymer additive.

3. A composition according to claim 2, wherein said composition comprises from about 97% to about 98%, by weight of the composition, of said methyl ester and from about 2% to about 3%, by weight of the composition, of said copolymer additive.

4. A composition according to claim 1, wherein said methyl ester has an iodine value of about 80 to about 110.

5. A composition according to claim 4, wherein said methyl ester has an iodine value of about 85 to about 100.

6. A composition according to claim 1, wherein said methyl ester comprises methyl myristate, methyl stearate, methyl linoleate, methyl palmitate, and methyl oleate.

7. A composition according to claim 1, wherein said $C_8$–$C_{15}$ alkyl methacrylate monomer comprises lauryl methacrylate, myristyl methacrylate, or mixtures thereof; and said $C_{16}$–$C_{24}$ alkyl methacrylate monomer comprises cetyl methacrylate, stearyl methacrylate, eicosyl methacrylate, or mixtures thereof.

8. A composition according to claim 1, wherein said composition has a pour point of less than −5° C.

9. A composition according to claim 8, wherein said composition, upon agitation, has a pour point of less than about −12° C.

10. A metal working lubricant comprising the composition of claim 1.

11. A process comprising the steps of:

(a) heating the copolymer additive of claim 1 to about 160° F.;

(b) heating the methyl ester of claim 1 to about 76° F.;

(c) mixing said copolymer additive and said methyl ester in a mixing vessel to form a composition; and (d) agitating said composition.

12. A method of lubricating comprising applying the composition of claim 1 to a machine tool or a workpiece.

* * * * *